US009890531B2

(12) United States Patent
Liberman et al.

(10) Patent No.: US 9,890,531 B2
(45) Date of Patent: Feb. 13, 2018

(54) MODULAR BUILDING SYSTEM WITH ADHESIVE-JOINED SPLINE CONNECTIONS BETWEEN WALL SECTIONS

(71) Applicants: Barnet L. Liberman, New York, NY (US); Aaron Liberman, New York, NY (US)

(72) Inventors: Barnet L. Liberman, New York, NY (US); Aaron Liberman, New York, NY (US)

( * ) Notice: Subject to any disclaimer, the term of this patent is extended or adjusted under 35 U.S.C. 154(b) by 0 days.

(21) Appl. No.: 15/094,528

(22) Filed: Apr. 8, 2016

(65) Prior Publication Data

US 2017/0058516 A1 Mar. 2, 2017

Related U.S. Application Data

(60) Provisional application No. 62/144,718, filed on Apr. 8, 2015.

(51) Int. Cl.

| | |
|---|---|
| ***E04B 2/54*** | (2006.01) |
| ***E04B 2/42*** | (2006.01) |
| ***E04B 2/46*** | (2006.01) |
| ***E04B 2/48*** | (2006.01) |
| ***E04B 2/68*** | (2006.01) |
| ***E04B 2/72*** | (2006.01) |
| *E04B 1/20* | (2006.01) |
| *E04B 1/41* | (2006.01) |
| *E04B 1/21* | (2006.01) |

(52) U.S. Cl.

CPC ..... *E04B 2/54* (2013.01); *E04B 2/42* (2013.01); *E04B 2/46* (2013.01); *E04B 2/48* (2013.01); *E04B 2/68* (2013.01); *E04B 2/72* (2013.01); *E04B 1/20* (2013.01); *E04B 1/21* (2013.01); *E04B 1/41* (2013.01)

(58) Field of Classification Search

CPC ..... E04B 2/64; E04B 2/54; E04B 2/46; E04B 2/42; E04B 2/48; E04B 1/41; E04B 2/562; E04B 1/20; E04B 1/21

USPC ..... 52/417, 461, 464, 481.1, 586.1

See application file for complete search history.

(56) References Cited

U.S. PATENT DOCUMENTS 1,375,788 A * 4/1921 Frischmann ..... E04L 32/56 52/91.1

2,102,443 A * 12/1937 Thorn ..... E04B 2/56 52/284

(Continued)

FOREIGN PATENT DOCUMENTS

FR 417960 A * 11/1910 ..... E04B 1/215

*Primary Examiner* — Adriana Figueroa

(74) *Attorney, Agent, or Firm* — Cozen O'Connor

(57) ABSTRACT

A modular building system is provided which includes modular wall sections. Each wall section has a concrete support column reinforced within by metal rods and at least two wall panels which are formed of concrete. Spline panels are attached to the wall panels at one or both ends of each wall section to connect the wall section to an adjacent wall section. The spline panels are formed of concrete and have a width less than half a width of any of the wall panels. The spline panels are positioned so that a portion thereof extends further in a longitudinal direction of the wall section than the respective wall panels to which the spline panels are joined, so that the spline panels cover joints between wall panels of adjacent wall sections when the adjacent wall sections are connected.

16 Claims, 11 Drawing Sheets

(56) References Cited

U.S. PATENT DOCUMENTS 2,851,873 A * 9/1958 Wheeler-Nicholson ..... E04B 1/165 52/262
3,133,322 A * 5/1964 Douglas ..... E04B 1/6145 52/127.11
3,429,092 A * 2/1969 Hart ..... E04B 1/0007 52/126.7
3,564,786 A * 2/1971 Baker ..... E04L 31/0007 52/126.7
3,594,971 A * 7/1971 Hughes ..... E04L 31/215 52/236.7
3,683,576 A * 8/1972 Sikes ..... E04B 1/6129 52/250
3,824,750 A * 7/1974 Antoniou ..... E04L 31/34815 52/223.4
4,443,988 A * 4/1984 Coutu, Sr. ..... E04B 1/80 52/309.2
4,765,105 A * 8/1988 Tissington ..... E04C 2/382 264/46.5
5,081,810 A * 1/1992 Emmert ..... B32B 5/18 52/220.2
5,617,686 A * 4/1997 Gallagher, Jr. ..... E04C 2/205 52/259
5,950,389 A * 9/1999 Porter ..... E04B 1/6145 403/DIG. 15
6,006,480 A * 12/1999 Rook ..... B32B 5/18 52/270
6,205,729 B1 * 3/2001 Porter ..... B32B 29/00 52/220.1
6,209,284 B1 * 4/2001 Porter ..... E04B 1/26 52/268
6,263,628 B1 * 7/2001 Griffi ..... E04C 2/288 52/309.11
7,051,484 B2 * 5/2006 Nanayakkara ..... E04B 1/165 52/309.12
8,844,243 B1 * 9/2014 Gillman ..... E04C 2/38 52/309.9
9,057,199 B2 * 6/2015 Gillman ..... E04F 13/0866
2009/0293395 A1 * 12/2009 Porter ..... E04B 1/12 52/309.1

* cited by examiner

1 DETAIL SECTION AT STEEL TUBE
SK-3 SCALE: NTS

MODULAR BUILDING SYSTEM WITH ADHESIVE-JOINED SPLINE CONNECTIONS BETWEEN WALL SECTIONS

CROSS-REFERENCE TO RELATED APPLICATION

This application claims priority to U.S. Provisional Patent Application No. 62/144,718, entitled "Modular Building System With Adhesive-Joined Spline Connections Between Wall Sections", filed Apr. 8, 2015, which is incorporated herein by reference in its entirety.

FIELD OF THE INVENTION

The disclosed embodiments relate to a modular building system with adhesive-joined spline connections between wall sections.

BACKGROUND OF THE INVENTION

In conventional construction techniques using drywall or gypsum board wall panels, the junctions between the wall panels must be sealed with fire-rated tape and fire-rated wallboard compound, i.e., spackle, must be applied to the junction section to provide a fire-rated wall section. These areas must then be sanded and painted to have a finished appearance, which increases costs and delays project completion.

SUMMARY OF THE INVENTION

The disclosed embodiments provide a modular building system that is efficient and economical. The disclosed modular wall sections can be used to form building structures which are fire-rated, and perhaps fireproof. The basic element is a concrete wall panel, which can be any dimension, but which may, for example, have dimensions of about 4 feet by 9 feet (or 4 feet by 9.5 feet) and a thickness of ⅝ inch. The wall panels are made with a lightweight concrete which is mixed with additives, such as, for example, potash and plastic or textile fibers. This composition allows the wall panels to have increased strength without increased thickness. The additives take the place of, for example, steel wire or other types of reinforcements which may be included for the purpose of keeping the concrete strong under heat conditions, such as in a fire condition. The wall panels may be produced to have the appearance of a finished product by, for example, forming the panel in a mold having a desired design, e.g., surface textures and/or decorative features. For example in the mold, a surface texture could be provided to give the wall panel the appearance of wood siding or stone, e.g., granite. The composition of the wall panels also has the property of being fire resistance/fireproof.

A challenge to be resolved was how to join wall panels together without any exposed connections so that they will be fire resistant/fireproof. In the disclosed embodiments, this is done using a narrow wall panel, i.e., spline, positioned behind the wall panels and attached with fire resistant/fireproof adhesive at the junctions between wall panels. Because the wall panels are not subject to significant forces in the lateral direction of the panels, i.e., a direction parallel to the surface of the panel, there are no significant shear forces on the adhesive attaching the spline to the wall panels. This results in a strong junction between the wall panels which does not leave gaps between wall panels, which would tend to diminish fire resistance.

In addition to the splines positioned at the junction between the wall panels, additional splines may be attached on both sides of the junction serve as supports for a transverse spline member which is installed within the volume of the wall section and which attaches to the wall panels both sides of the wall section.

The disclosed embodiments include wall sections which are structural, i.e., loadbearing, and wall sections which are used for interior partitions, i.e., non-loadbearing. The loadbearing wall sections replace conventional wall sections, such as 8-inch cinderblock walls, which can be used to build structures of up to 10 stories. The non-loadbearing wall sections replace conventional drywall/gypsum board wall sections for interior use. The non-structural modular wall sections, with two finished sides but without concrete pier and beam in the interior, having an overall size of about 4 feet by 10 feet, should weigh about 500 lbs. The structural modular wall sections with concrete pier and beam would weigh about 1000 lbs for a 4 feet by 10 feet unit, with two finished sides.

In one aspect, the disclosed embodiments provide a modular building system comprising a plurality of modular wall sections. Each wall section includes a concrete support column reinforced within by metal rods and at least two wall panels. Each wall panel has an inner wall surface contacting the support column and an outer wall surface. The wall panels of opposite sides of the support column form an interior volume between the inner wall surfaces thereof, the wall panels being formed of concrete. Spline panels may be attached to the wall panels at at least one end of each wall section to connect the wall section to an adjacent wall section. The spline panels may be formed of concrete and have a width less than half a width of any of the wall panels. The spline panels may be positioned so that a portion thereof extends further in a longitudinal direction of the wall section than the respective wall panels to which the spline panels are joined, so that the spline panels cover joints between wall panels of adjacent wall sections when the adjacent wall sections are connected.

Embodiments may include one or more of the following features.

The spline panels may be attached to the wall panels using fire-rated adhesive. Two spline panels may be positioned at one end of the wall section. A single spline panel may be positioned at each end of the wall section. The spline panels may be formed of the same material as the wall panels. The spline panels may be joined to the inner surface of the wall panels.

The wall panels may be formed of concrete incorporating fiber additives. The wall panels may be formed of concrete including at least one of the following additives: potash, fly ash, plastic fibers, steel wire fibers, and textile fibers. The interior volume between the wall panels may include at least one of: insulation, preinstalled plumbing, and preinstalled electrical wiring.

Two spline panels may be attached to the wall panels at one end of the wall section so that the wall section is configured to be connected to an adjacent wall section having an end with no spline panels attached thereto. A first one of the spline panels may be attached to one of the wall panels at one end of the wall section and a second one of the spline panels may be attached to the other of the wall panels at the opposite end of the wall section, so that the wall section is configured to be connected to an adjacent wall section having one spline panel attached to each end thereof.

The spline panels of the wall section may be connected to wall panels of adjacent wall sections using fire-rated adhesive. The wall panels may be affixed to the support column using fire-rated adhesive or using a combination of fire-rated adhesive and fasteners. The wall section may include at least four wall panels, which may be configured so that on each side of the wall section, two of the wall panels are positioned side-by-side with a joint therebetween being aligned in a central portion of a face of the support column.

The wall section may further include transverse spline panels extending in a transverse direction between the wall panels and being attached to the inner surfaces of the wall panels. The transverse spline panels may be positioned inward at a determined distance in the longitudinal direction from edges of the wall panels.

BRIEF DESCRIPTION OF THE DRAWINGS

The above and/or other aspects and advantages will become more apparent and more readily appreciated from the following detailed description of the disclosed embodiments taken in conjunction with the accompanying drawings of which.

DETAILED DESCRIPTION OF THE DRAWINGS

Figure 1:
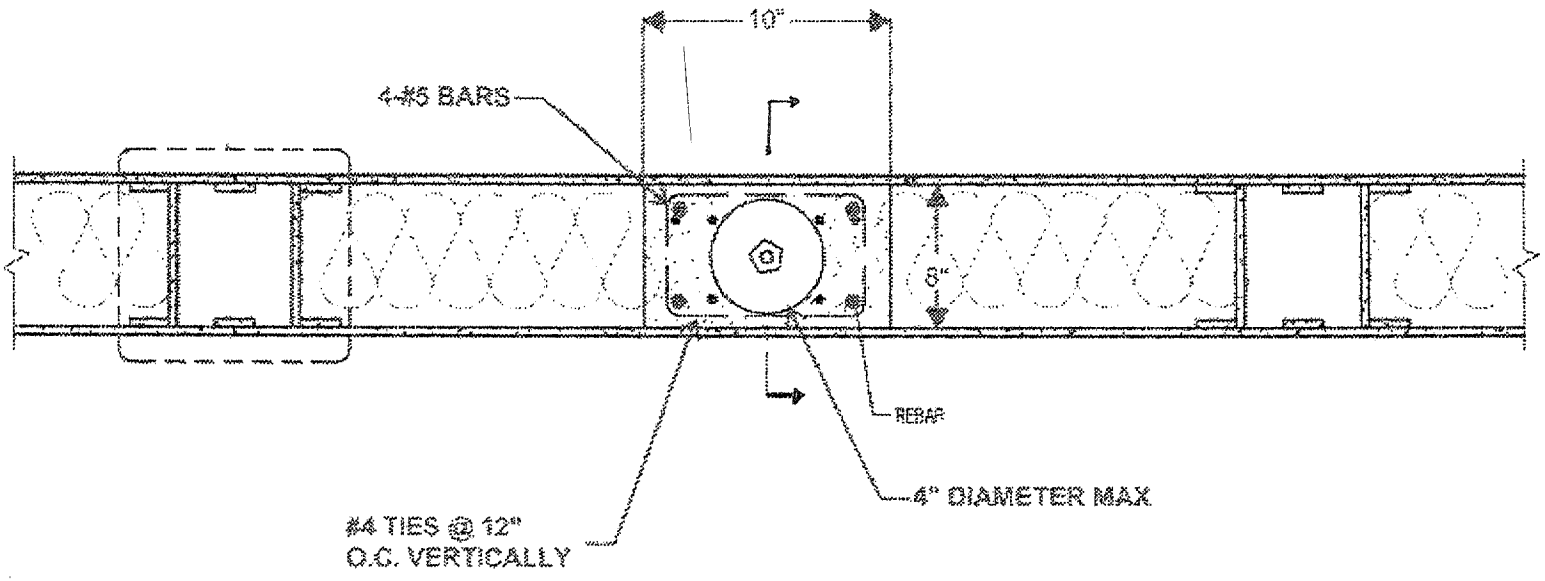
FIG. 1 is a cross-sectional view of a structural modular wall section connected to adjacent modular wall sections using spline connections joined with fire-rated adhesive.

FIG. 1 depicts a structural modular wall section connected to adjacent modular wall sections using spline connections joined with fire-rated adhesive. The panel has a central support column (or "pier") which may be formed of concrete reinforced with steel rods, i.e., rebar. The pier may be rectangular in shape, with the wider dimension of the pier facing in an outward direction relative to the modular wall section and the narrower dimension facing in a longitudinal direction of the modular wall section. The pier may be, for example, about 8 inches by about 12 inches. In alternative embodiments, the pier may be square in shape and may be, for example, about 8 inches by about 8 inches.

The structural modular wall section further includes two outward facing wall surfaces, each formed by one or more concrete wall panels. The wall panels are made with a lightweight concrete which is mixed with additives, such as, for example, potash, fly ash, plastic fibers, steel wire fibers, and/or textile fibers. For example, Novomesh 850 is a secondary reinforcement system, i.e., filler, for concrete which is formed from a blend of cold drawn steel wire fiber and 100 percent virgin homopolymer polypropylene graded multifilament fiber (available from Propex Operating Company, LLC, Chattanooga, Tenn.). Alternatively, wall panels may be formed of ⅝ inch gypsum wall board with a facing of 4 mm thick fiber cement board (available from American Fiber Cement Corp., Littleton, Colo.).

Each face of the modular wall section may, for example, be formed of two 4 feet by 9.5 feet concrete wall panels. The wall section sections are positioned on opposite sides of the pier so as to form an interior space between the wall panels. The width of the interior space is defined by the narrower dimension of the pier (although in alternative embodiments the pier may be oriented to have the narrower dimension aligned with the longitudinal direction of the wall section in which case the interior space would be defined by the wider dimension of the pier). The total width of a structural modular section may be, for example, about 8 inches. The interior space may be filled with insulation and may also include preinstalled plumbing and electrical wiring.

On each side of the wall section, two wall panels may be positioned to side-by-side such that they join in the middle of the wider, i.e., outward facing, side of the pier. The wall panels may be affixed to the pier by fire-rated adhesive or using a combination of adhesive and fasteners, such as screws. The use of fire-rated adhesive join wall panels is discussed in further detail below.

Figure 2:
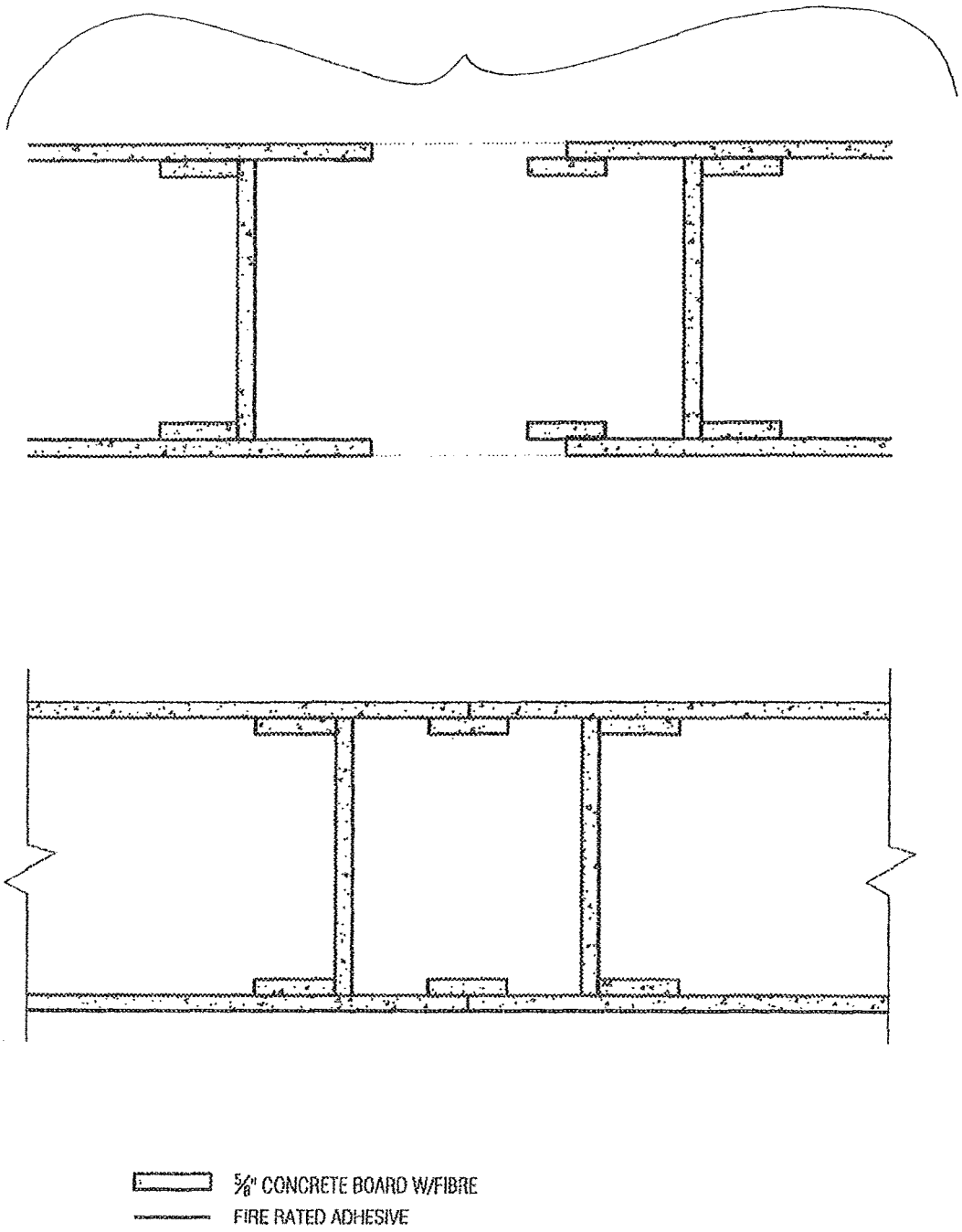
FIG. 2 depicts is an enlarged cross-sectional view of a connection between two of the modular wall sections depicted in FIG. 1.

As shown in greater detail in FIG. 2, the ends of each wall section are configured to connect to an adjacent section. The end configuration may, for example, include narrow concrete planks formed of the same material as the concrete wall panels. These planks may be used as splines which are positioned behind a point at which two concrete wall panels meet. The splines may be pre-installed at one end of each wall section, with no splines installed at the opposite end of the wall section, so that when two wall sections are brought together, splines will be available on one of the wall sections to form a connection between the two sections (as shown in FIG. 2). Alternatively, each wall section may have a spline on only one of the opposite wall surfaces at each end.

In embodiments in which the wall panels are formed of gypsum wall board with a facing of fiber cement board, there may be a spline or splines (e.g., formed of wood, metal, etc.) on the inside of the wall section with a piece of fiber cement board positioned on the outside of the gypsum wall board so that it covers the joint between the wall board of two adjacent wall sections. This seam-covering piece of cement board may be installed after the two wall sections are joined.

Additional concrete planks are installed behind the concrete wall panels at a distance from the end of the wall section. These additional planks are used to support transverse concrete plank, which extends from the interior surface of one concrete wall panel the interior surface of the opposite concrete wall panel. The transverse concrete planks provide support to the concrete wall panels in a manner similar to the concrete pier. The transverse concrete planks also serve to seal the ends of the wall section said that insulation and other internal materials are sealed within the wall section. The transverse concrete planks are positioned at a determined distance from the end of the wall section, thereby forming a cavity at the ends of each wall section.

The width of the typical spline plank may be, for example, about 4 inches, which would allow for 2 inches of the spline plank to overlap the concrete wall panel of each of the wall sections being connected. The cavity at the end of each wall section may be sized to have a depth which accommodates the 2 inch portion of the spline plank, with an additional space to allow for maneuvering and measurement tolerances. Other embodiments, the spline plank may have a width of about 2 inches, which results in an overlap with each wall panel being joined at the spline connection of about 1 inch in width. In such a case, the depth of the cavity at the end of the wall may be as little as 1 inch. In the embodiment of FIG. 2, a somewhat larger cavity space is depicted, the depth of which is approximately one and a half times the width of the spline plank.

The spline planks are joined to the concrete wall panels using a fire-rated adhesive material. This configuration allows for the joined wall sections to have fire resistant/fireproof properties without the need for the use of fire-rated tape and compound material at the joints between the concrete panels, as is required in conventional approaches. For example, the adhesive may be Vitcas HB60, which is a heat-resistant adhesive designed for use in the construction of stoves, pizza ovens, tiled stoves and joining outdoor constructions, such as grills and fireplaces (available from Vitcas Ltd., Bristol, UK). This adhesive material has a longer set time, e.g., about two hours, which allows for maneuvering and repositioning of the wall sections after they are joined with the adhesive material.

Figure 3:
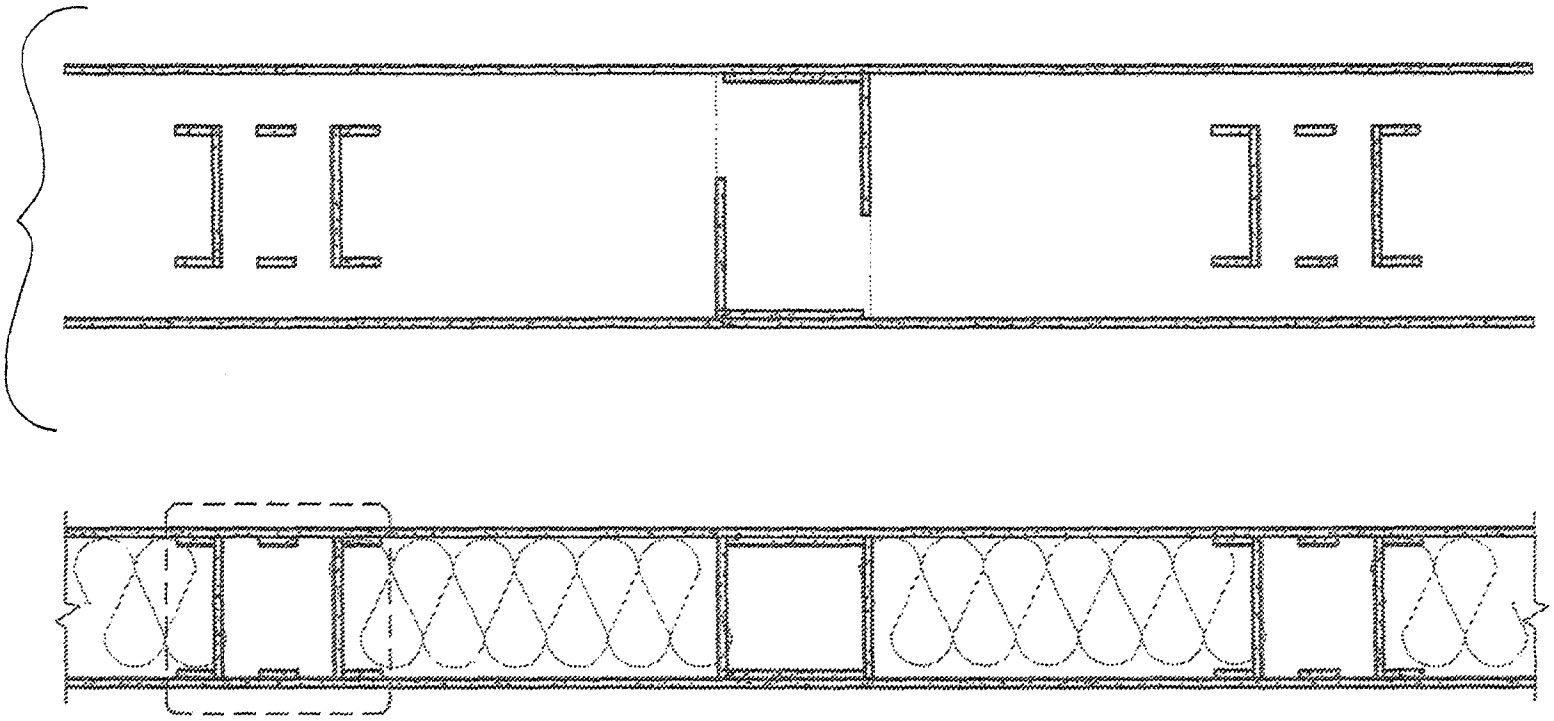
FIG. 3 is a cross-sectional view of the modular internal partition wall section showing internal support spline planks attached between inner faces of the wall panels.

FIG. 3 is a cross-sectional view of a modular internal partition wall section showing internal support spline planks attached between inner faces of the wall panels. This type of modular wall section may be used as an interior partition wall. It is similar to the configuration discussed above (see FIGS. 1 and 2) but does not have the concrete pier elements or concrete beam elements. The partition wall section, thus, is formed of a number of lightweight concrete wall panels which are joined at ends of the wall section by transverse concrete planks and spline connecting planks (in a manner similar to the junction between two structural modular wall sections, described above and shown in FIG. 2). The interior space may be narrower than for a structural modular wall section. For example, the overall width of the modular partition wall section may be about 3 or 4 inches.

The wall panels are also joined using internal support spline planks, which are similar to the transverse and connecting spline planks used to join modular wall sections, as discussed above (see FIG. 2). The internal support spline planks provide support against lateral loading on the wall panels. A first spline plank is attached with adhesive on the inner face of each of the wall panels. A second spline plank is attached perpendicular to the inner face of each of the wall panels such that a corner of the second spline plank meets a corner of the first spline plank, thereby forming an L-shaped arrangement of planks. On the opposing wall panel inner face, a third spline plank is attached at an opposite corner of a fourth spline plank, thereby forming an L-shaped arrangement in an orientation rotated by 180 degrees.

Figure 4:
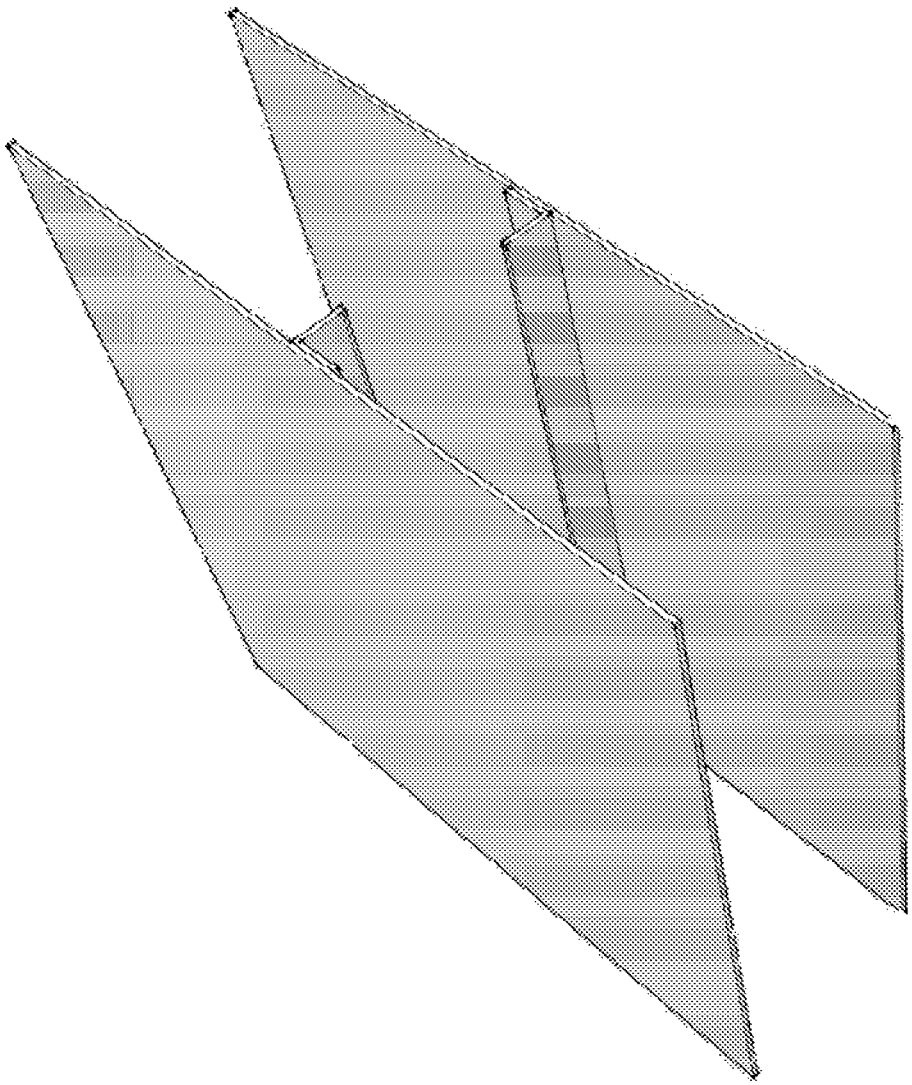
FIG. 4 is a perspective exploded view of two opposing wall panels, each having internal support spline planks attached to an inner face thereof.
Figure 5:
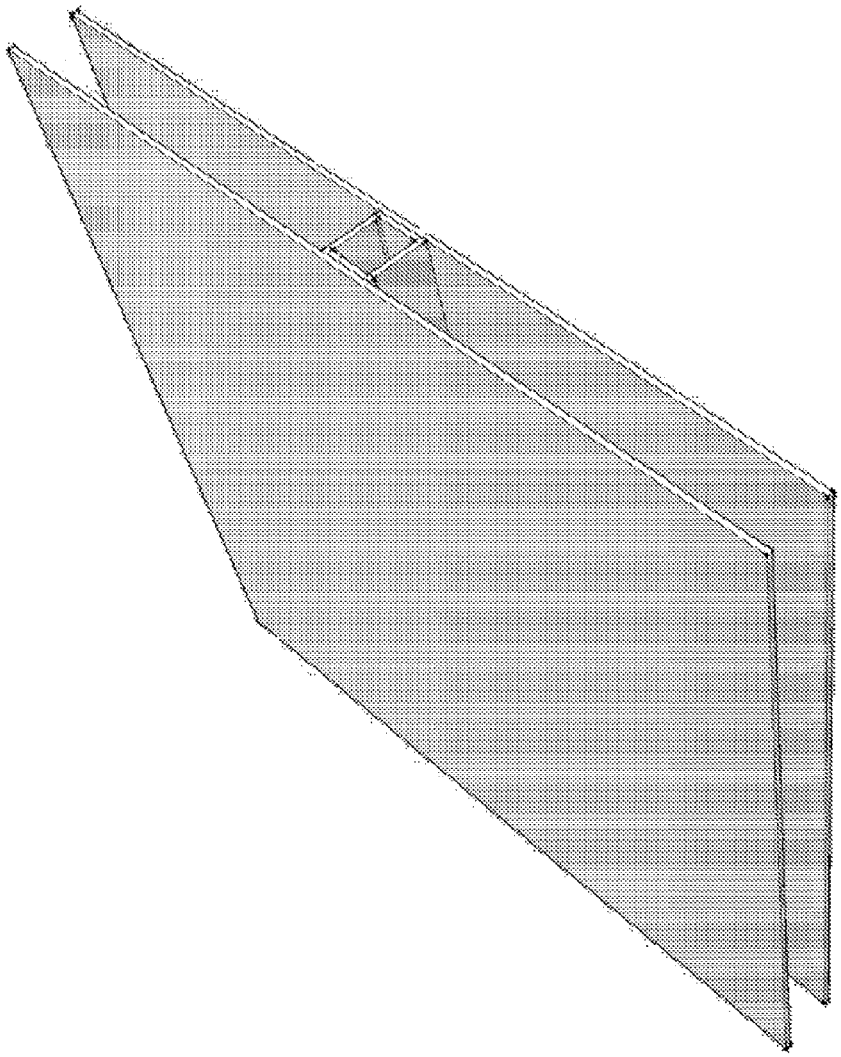
FIG. 5 is a perspective view of two opposing wall panels, each having internal support spline planks attached to an inner face thereof which are, in turn, attached to the support spline planks of the opposing wall panel.

FIG. 4 is a perspective exploded view of two opposing wall panels, each having an L-shaped arrangement of internal support spline planks attached to an inner face thereof. FIG. 5 is a perspective view of the two opposing wall panels and corresponding L-shaped spline planks as they appear in a fabricated internal partition wall section. The two L-shaped arrangements are joined with adhesive to form a hollow, column-like structure, which is generally rectangular, but may be square in certain embodiments. In this manner, a set of four internal support spline planks becomes, in effect, a lightweight column to provide internal support for the wall panels of the partition wall section.

Figure 6:
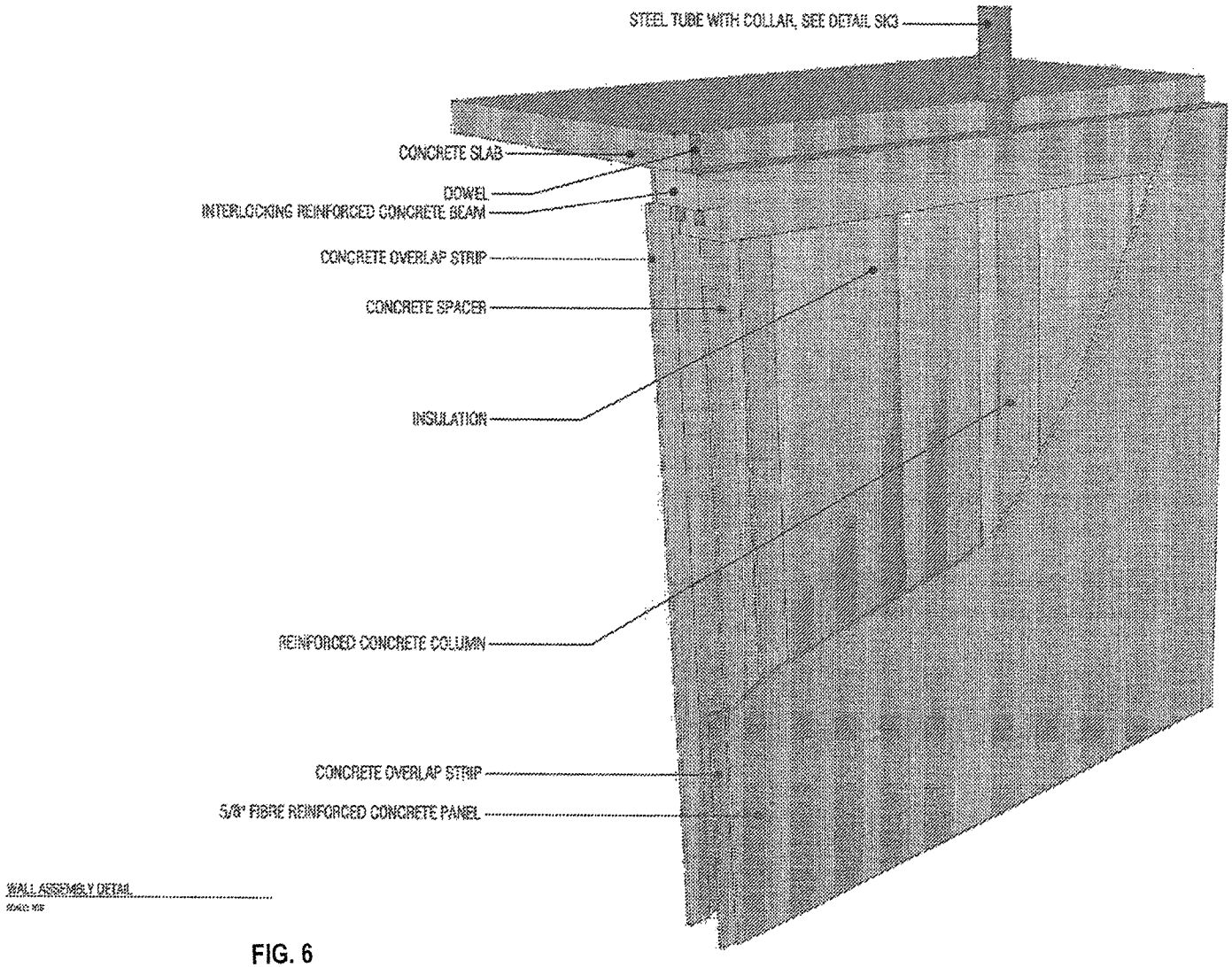
FIG. 6 is a perspective cut-away view of a structural modular wall section with a concrete slab attached to the top thereof.

FIG. 6 a perspective cut-away view of a structural modular wall section showing a ⅝ inch fiber-reinforced concrete panel attached as a wall surface to a central pier formed of reinforced concrete (this example shows a single concrete panel attached to the pier, rather than two panels being joined with a seam at the pier). The interior space, which is formed between the opposite wall panels attached to the pier, incorporates insulation material. The interior space is sealed by a transverse concrete plank, i.e., concrete spacer, which extends between the opposing interior surfaces of the wall panels. The modular wall section includes at least one concrete spline plank, i.e., concrete overlap strip, to allow the wall section to be joined with an adjacent wall section.

As further shown in FIG. 6, modular wall section is topped by a concrete beam which attaches to the top of the concrete pier and which is positioned between the concrete wall panels. The concrete beam may include a step portion at the end thereof to allow it to interconnect with concrete beams of adjacent wall sections (as discussed in further detail below). A concrete ceiling slab may be attached to the concrete beam and the central pier. The concrete ceiling slab may be attached to the concrete beam using a steel dowel which extends upward from the concrete beam into a receiving hole of the concrete ceiling slab, e.g., from the step portion of the concrete beam.

The central concrete pier may include a steel rod positioned in the center thereof, e.g., a threaded steel rod, which may be positioned in an interior portion of the pier and surrounded with grout or sand. The steel rod extends a distance beyond a top end of the concrete pier and through corresponding holes in the concrete beam and concrete slab to allow these components to be attached using a collar mechanism attached to the top of the steel rod, as discussed in further detail below.

Figure 7:
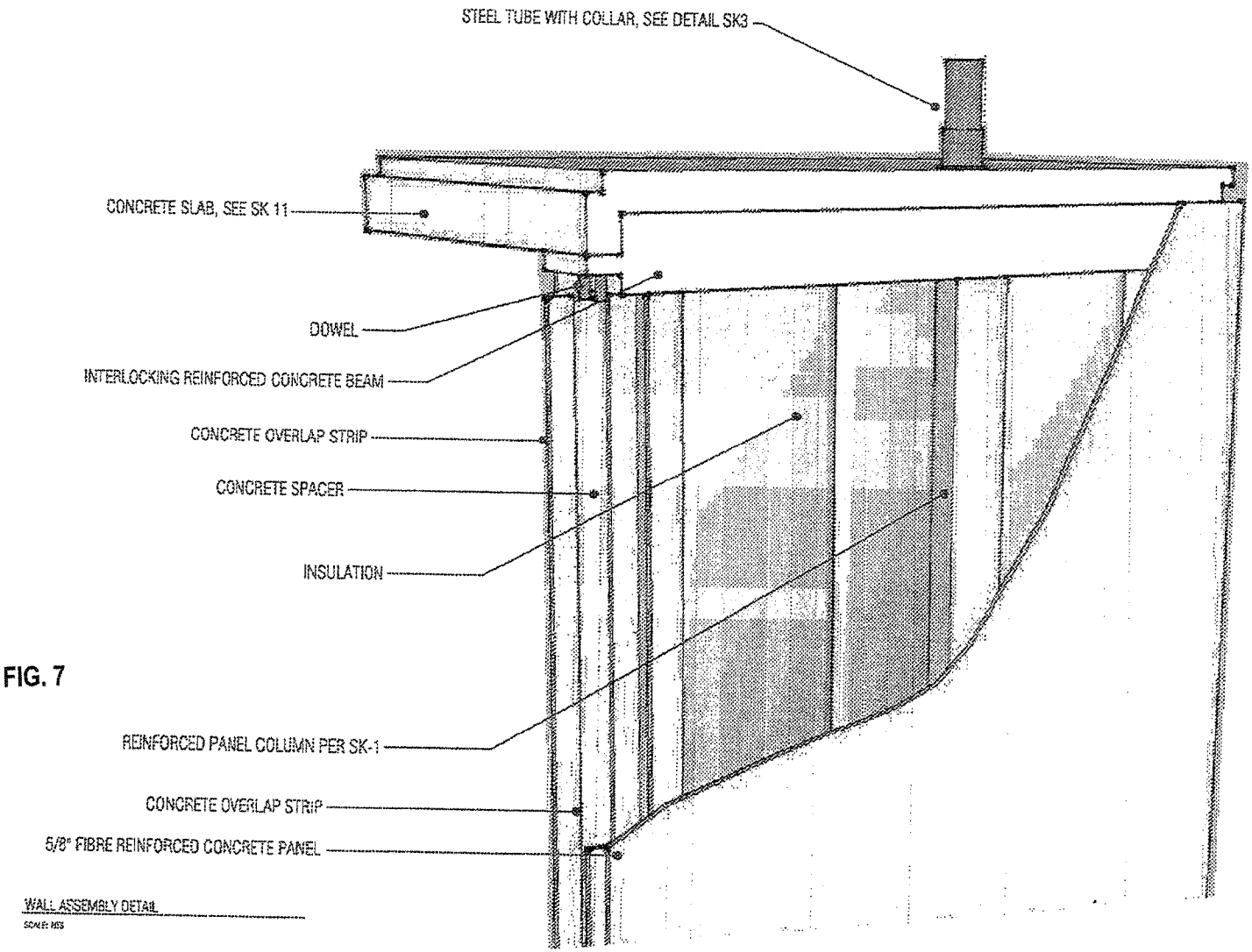
FIG. 7 is a perspective cut-away view of the structural modular wall section with a concrete slab and joist arrangement attached on top thereof.

FIG. 7 is a perspective cut-away view of the structural modular wall section with a concrete slab and joist arrangement attached on top thereof. As in the configuration of FIG. 6, there is a fiber-reinforced concrete panel attached (e.g., a ⅝ inch thick panel) as a wall surface to a central pier formed of reinforced concrete. The modular wall section is topped by a concrete beam which attaches to the top of the concrete pier and which is positioned between the concrete wall panels. The concrete beam may include a step portion at the end thereof to allow it to interconnect with concrete beams of adjacent wall sections (as discussed in further detail below).

Figures 8A, 8B:
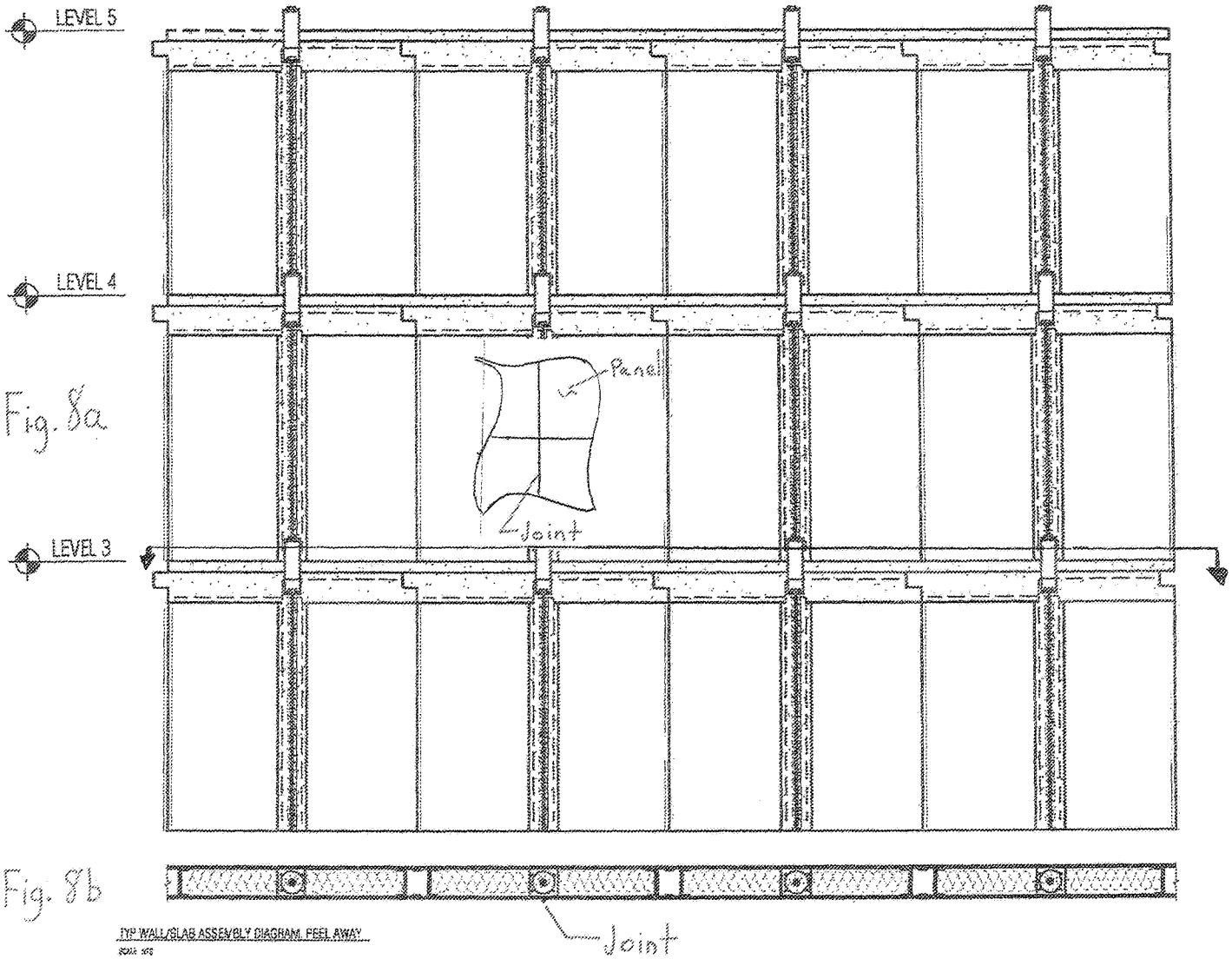
FIGS. 8*a* and 8*b* depict a cross-sectional view and a top view of the upper levels of a multistory structure formed using the structural modular wall sections described herein.
Figure 9:
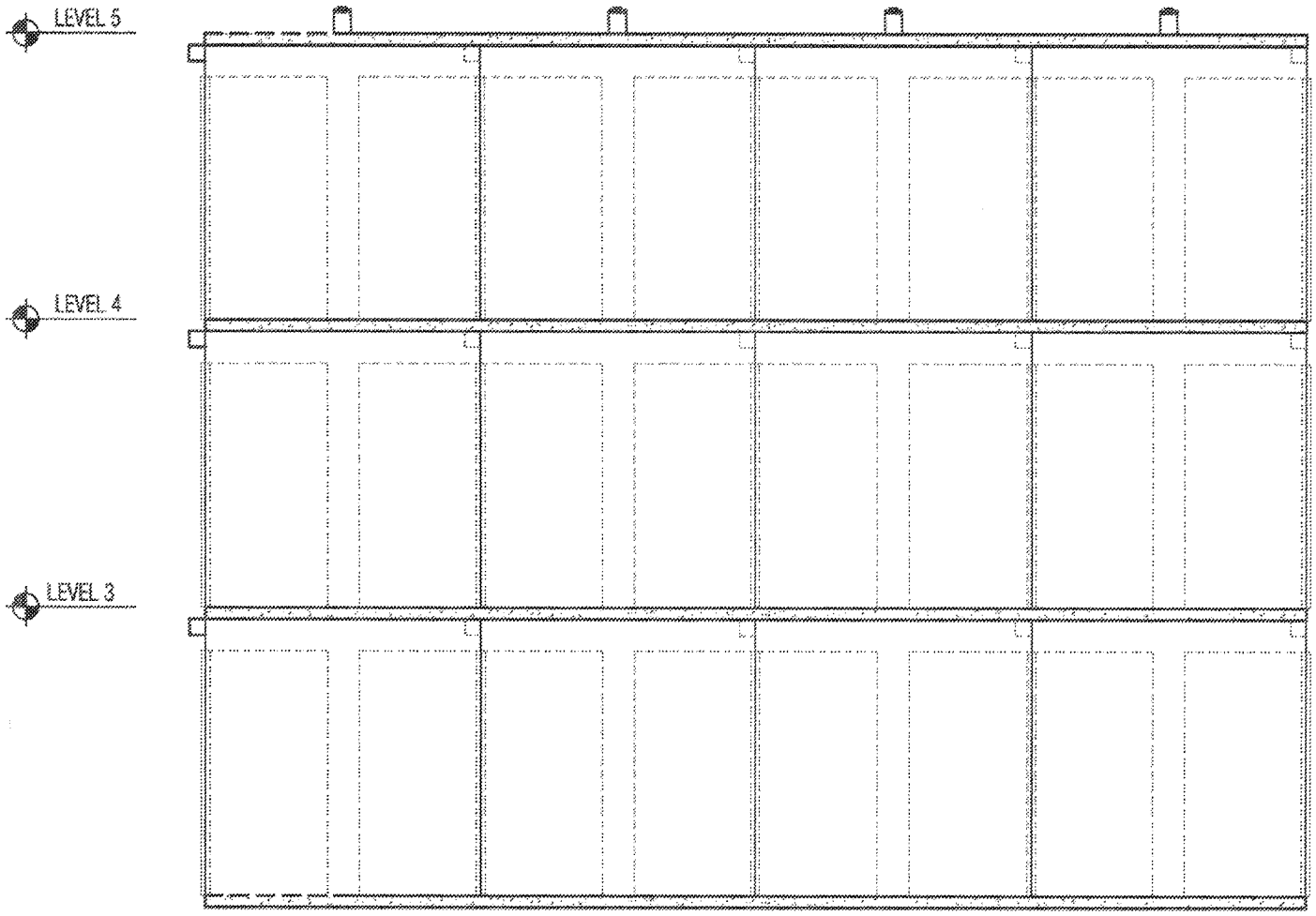
FIG. 9 is an exterior view of the upper levels of the multistory structure depicted in FIG. 8.

The concrete ceiling slab is attached to the concrete beam and the central pier. The concrete slab includes a joist at an end thereof which runs along a transverse edge of the concrete slab relative to the longitudinal direction of the concrete beam and modular wall section. The joist may extend both outward and downward from the transverse edge of the concrete slab to form a step along that edge. The joist, in turn, fits into a step portion of the concrete beam. The next adjacent concrete ceiling slab rests on top of the step formed by the joist portion. The concrete ceiling slab may be attached to the concrete beam using one or more steel dowels which extend upward from the step portion of the concrete beam into a receiving hole of the concrete ceiling slab FIG. 8 depicts a cross-sectional view of the upper levels of a multistory building formed using the structural modular wall sections described herein. FIG. 9 is an exterior view of the upper levels of the multistory structure depicted in FIG. 8. In this example, each central pier element has two lightweight concrete wall panels positioned on each side thereof, i.e., on a building interior-facing side and a building-exterior facing side of the central pier. The wall panels meet at the concrete pier and extend in a longitudinal direction to form the wall section.

A concrete beam extends in the longitudinal direction of the wall section and is positioned between the interior-facing and exterior-facing wall panels. The concrete beam is attached to the top of the central pier and may be formed of two separate beam sections that meet at the central pier. Alternatively, the concrete beam may be formed from a single piece of material which extends along an entire length of the wall section. The concrete beams of adjacent wall sections are joined at the connection between the wall sections.

Concrete slabs are positioned on the concrete beams to form the floor/ceiling slabs of the multistory building. The cross-sectional view of FIG. 8 shows the steel rods positioned in the concrete piers. The steel rods of each floor of the multistory building are joined using a coupling element (described in further detail below). The steel rods extend through an opening in the concrete slabs of each floor, thereby attaching the concrete slabs to the concrete piers.

Figure 10:
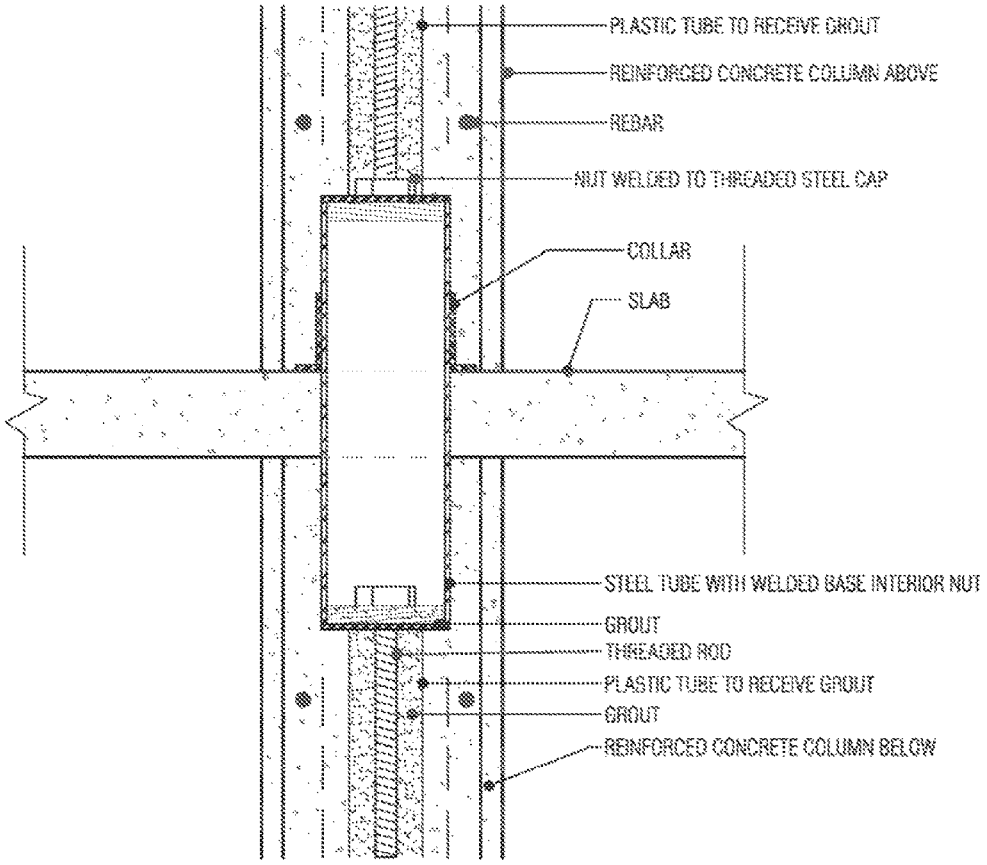
FIG. 10 is an enlarged cross-sectional view of a connection between the steel rods of the central concrete piers of two floors of the multistory structure depicted in FIGS. 8 and 9.

FIG. 10 is an enlarged cross-sectional view of a connection between the steel rods of the central concrete piers of two floors of the multistory structure depicted in FIGS. 8 and 9. The concrete piers of the upper and lower floors which meet at the connection depicted in this figure are reinforced with steel elements, i.e., rebar, and each have a steel threaded rod extending through a central cavity thereof. The threaded rod may be surrounded by grout or sand. A plastic tube may surround the central cavity so as to contain therein the grout or sand and threaded rod.

The threaded steel rods of the concrete piers of the two floors extend into a coupling element, which may be formed, for example, of steel. The coupling element may be in the form of a steel tube which is sealed at both ends with a steel top/bottom plate. The coupling element extends into the cavity in the bottom portion of the concrete pier of the upper floor and a cavity in the top portion of the concrete pier of the lower floor.

In particular embodiments, the coupling element is installed in the top of the concrete pier of each modular wall section. In such a case, a modular wall section of an upper floor is lowered onto the building so that the coupling element is accepted into the bottom cavity of the concrete pier of the upper floor as it is lowered onto the slab. The cavity portion at the bottom of the concrete pier of the upper floor may be surrounded by a steel collar to prevent damage to the concrete piers as the modular wall structure is lowered onto the coupling element. The coupling element also extends through a hole in the concrete slab between the floors.

In some embodiments, the coupling element may be installed in the top of a concrete pier after the slab of an upper floor is lowered onto the concrete beams which, in turn, are positioned on top of the concrete pier. The coupling element may have a collar which extends around the periphery thereof and which comes into contact with the top of the slab after the coupling element is installed. This configuration ensures that the slab is securely connected to the concrete piers of the floor below.

A nut may be welded to one of the top or bottom plates in the interior of the coupling element so as to receive a threaded rod and allow the coupling element to be tightened to the threaded rod. For example, as shown in FIG. 10, a nut may be welded to the bottom plate of the coupling element. Alternatively, the threaded steel rod may have a nut at the top and may be inserted through the coupling element and then into the central portion of the concrete pier.

A nut may be welded to the top plate of the coupling element so that the nut is external to the coupling element. This may be used to receive the threaded rod of the upper floor, which may, for example, be inserted through the central portion of the concrete pier of the upper floor after the structural wall section of the upper floor is installed and then screwed into the nut on the top plate of the coupler. The top plate of the coupler may also have a flared portion (not shown) which extends around the periphery of the nut and guides the threaded steel rod into position in the nut as it is inserted from above into the central portion of the concrete pier of the upper floor.

One aspect of the coupling configuration discussed above is that it allows for a building structure to be assembled and disassembled very efficiently using the modular wall sections described herein. In the disassembly process, a threaded rod may be unscrewed from the nut of the steel coupler of the floor below so that the modular wall section can be lifted off of the floor slab and removed from the building structure. The use of sand in the central cavity of the concrete pier allows for the threaded rod to be turned to be unscrewed. Alternatively, if grout is used in the central cavity, then the grout will be broken up by the action of turning the threaded steel rod to unscrew it from the nut of the coupler element.

Another aspect of the disassembly process, the spline connections between two modular wall sections may be disassembled by cutting through the spline plank which is positioned behind the joint between the concrete wall panels, i.e., at a point where two modular wall sections meet. Modular wall sections disassembled in this manner may be reassembled by adding another spline plank behind the one that has been cut in half and attaching the new spline plank using the fire-rated adhesive, as discussed above. A connecting fitting of the coupler which is used to receive a threaded rod can instead receive an eyelet for lifting the modular wall section into place.

Figure 11:
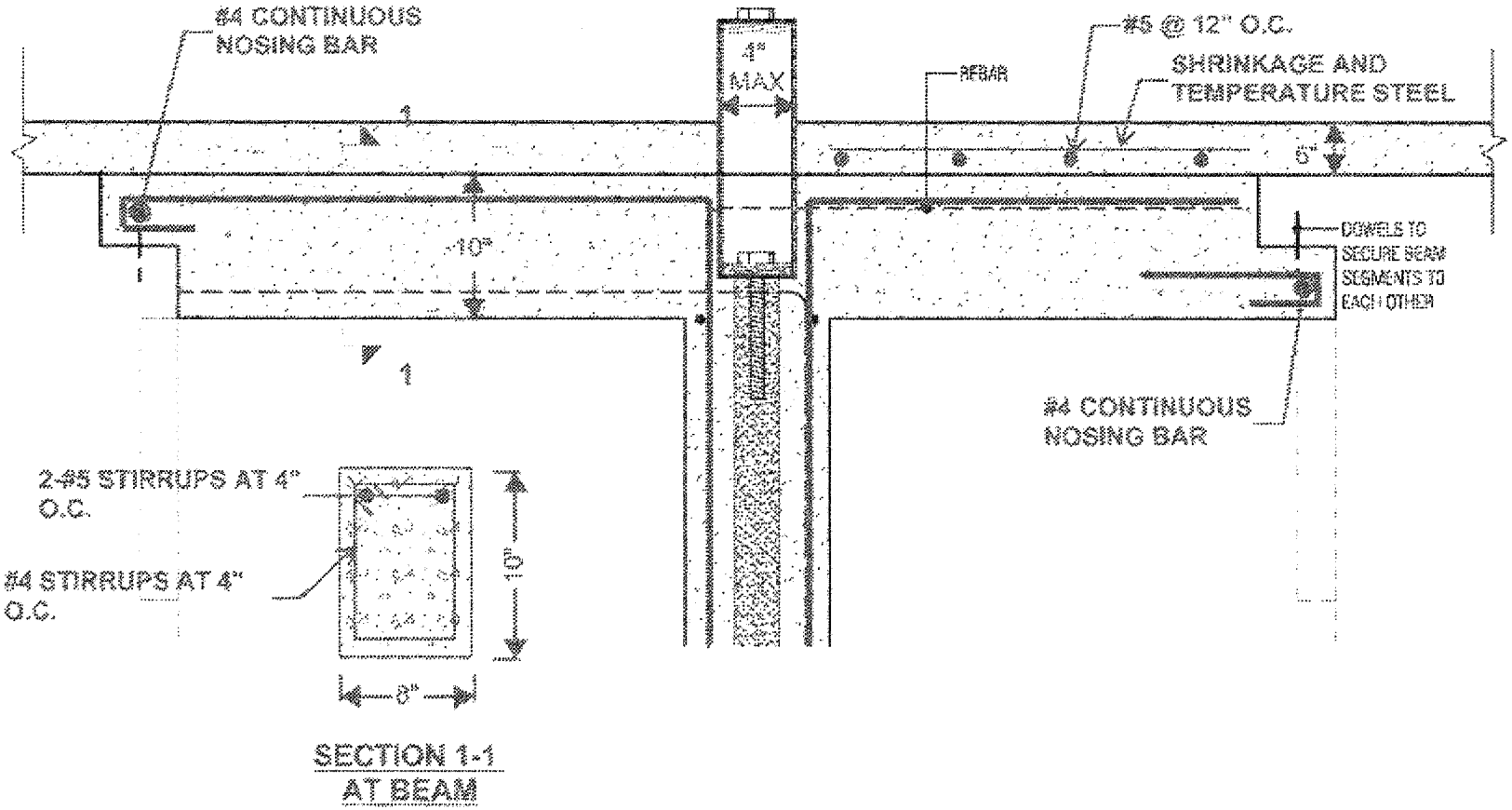
FIG. 11 is an enlarged cross-sectional view of the top of a modular wall section, with concrete beam and concrete slab position thereon, prior to installation of a modular wall section of the next higher floor.

FIG. 11 is an enlarged cross-sectional view of the top of a modular wall section, with concrete beam and concrete slab position thereon, prior to installation of a modular wall section of the next higher floor. The concrete beam has a step portion at each end with dowels extending therefrom, which may be formed of concrete or which may be embedded steel rods. The dowels of each section are inserted into corresponding holes of an adjacent concrete beam to form an interlocking structure. A modular wall section of a next higher floor may then be lowered onto the slab so that the concrete piers of the upper floor are positioned on top of the steel coupling elements of the lower floor.

The concrete beams may have additional dowels (see FIGS. 6 and 7) which extend upward to project into holes in the slab to provide additional support for the slab. In the configuration of FIG. 7, the dowel extending from the concrete beam is received in the joist portion of the concrete slab.

Although example embodiments have been shown and described in this specification and figures, it would be appreciated by those skilled in the art that changes may be made to the illustrated and/or described example embodiments without departing from their principles and spirit.

What is claimed is:

1. A multifloor modular building system comprising a plurality of modular wall sections, each wall section comprising:

a concrete support column reinforced within by metal rods comprising:

a tube configured to pass through a slab separating adjoining floors;

an upper end cap attached to an upper end of the tube;

a lower end cap attached to a lower end of the tube;

a first nut attached to one of the upper end cap and the lower end cap; and a threaded rod threadingly attached to the first nut;

at least two wall panels, each wall panel having an inner wall surface contacting the support column and an outer wall surface, the wall panels of opposite sides of the support column forming an interior volume between the inner wall surfaces thereof, the wall panels being formed of concrete; and spline panels attached to the wall panels at at least one end of each wall section to connect the wall section to an adjacent wall section, the spline panels being formed of concrete and having a width less than half a width of any of the wall panels, wherein the spline panels are positioned so that a portion thereof extends further in a longitudinal direction of the wall section than the respective wall panels to which the spline panels are joined, so that the spline panels cover joints between wall panels of adjacent wall sections when the adjacent wall sections are connected.

2. The system of claim 1, wherein the spline panels are attached to the wall panels using fire-rated adhesive.

3. The system of claim 1, wherein two spline panels are positioned at one end of the wall section.

4. The system of claim 1, wherein a single spline panel is positioned at each end of the wall section.

5. The system of claim 1, wherein the spline panels are formed of the same material as the wall panels.

6. The system of claim 1, wherein the spline panels are joined to the inner surface of the wall panels.

7. The system of claim 1, wherein the wall panels are formed of concrete incorporating fiber additives.

8. The system of claim 1, wherein the wall panels are formed of concrete comprising at least one of the following additives: potash, fly ash, plastic fibers, steel wire fibers, and textile fibers.

9. The system of claim 1, wherein the interior volume between the wall panels comprises at least one of: insulation, preinstalled plumbing, and preinstalled electrical wiring.

10. The system of claim 1, wherein two spline panels are attached to the wall panels at one end of the wall section so that the wall section is configured to be connected to an adjacent wall section having an end with no spline panels attached thereto.

11. The system of claim 1, wherein a first one of the spline panels is attached to one of the wall panels at one end of the wall section and a second one of the spline panels is attached to the other of the wall panels at the opposite end of the wall section, so that the wall section is configured to be connected to an adjacent wall section having one spline panel attached to each end thereof.

12. The system of claim 1, wherein the spline panels of the wall section are connected to wall panels of adjacent wall sections using fire-rated adhesive.

13. The system of claim 1, wherein the wall panels are affixed to the support column using fire-rated adhesive or using a combination of fire-rated adhesive and fasteners.

14. The system of claim 1, wherein the wall section comprises at least four wall panels, the wall panels being configured so that on each side of the wall section, two of the wall panels are positioned side-by-side with a joint therebetween being aligned in a central portion of a face of the support column.

15. The system of claim 1, wherein the wall section further comprises transverse spline panels extending in a transverse direction between the wall panels and being attached to the inner surfaces of the wall panels.

16. The system of claim 15, wherein the transverse spline panels are positioned inward at a determined distance in the longitudinal direction from edges of the wall panels.

* * * * *